United States Patent [19]

Murray et al.

[11] Patent Number: 4,591,466

[45] Date of Patent: May 27, 1986

[54] METHOD FOR POSITIONING AND STABILIZING A CONCRETE SLAB

[75] Inventors: Clarence L. Murray; John T. Bright, both of Tulsa, Okla.

[73] Assignee: Foundation Control Systems, Tulsa, Okla.

[21] Appl. No.: 680,774

[22] Filed: Dec. 12, 1984

Related U.S. Application Data

[62] Division of Ser. No. 543,624, Oct. 20, 1983, Pat. No. 4,507,069.

[51] Int. Cl.[4] ..... E04B 1/16

[52] U.S. Cl. ..... 264/35; 52/742; 264/36; 405/229; 405/230; 405/269

[58] Field of Search ..... 264/31, 34, 35, 36; 425/13, 59; 52/125.1, 742, 745; 405/229, 230, 269

[56] References Cited

U.S. PATENT DOCUMENTS 3,040,411 6/1962 Messenger ..... 264/34 X
3,194,853 7/1965 Weise et al. ..... 264/36
3,530,675 9/1970 Turzillo ..... 405/229
4,092,832 6/1978 Mattson ..... 405/229
4,240,995 12/1980 Milne ..... 264/36

FOREIGN PATENT DOCUMENTS 52-6114 1/1977 Japan ..... 52/742

*Primary Examiner*—Jan Silbaugh
*Attorney, Agent, or Firm*—Head, Johnson & Stevenson

[57] ABSTRACT

A method of lifting and stabilizing a concrete slab having an opening therein in which a plate is attached to the top surface of the slab, the plate having an opening coinciding with the opening in the slab, a hydraulic jack having a downwardly extending piston is removeably secured to the plate and a series of tubular shafts are forced downwardly through the opening in the plate and the slab to penetrate the earth beneath the slab and apply lifting force. When the slab has been lifted to the desired elevation, grout, such as a concrete slurry, can be injected below the slab so that the slab is stabilized in the selected elevational position. After the plate is removed the hole in the slab is filled.

7 Claims, 10 Drawing Figures

METHOD FOR POSITIONING AND STABILIZING A CONCRETE SLAB

CROSS-REFERENCE TO RELATED APPLICATION

This application is a divisional application of my co-pending application Ser. No. 543,624 filed Oct. 20, 1983, now U.S. Pat. No. 4,507,069.

SUMMARY OF THE INVENTION

Many residential and commercial structures built today employ construction techniques in which the floor of the structure is in the form of a concrete slab poured on the earth. In some instances, slabs are poured on fill material which in turn rests on the earth. As long as the earth or fill material beneath the slab is stable and supplies supporting force, the slab remains in position and provides a very adequate floor. However, if the support underneath the slab shifts, sags, or for any other reason diminishes, the slab may sink downwardly from its original position relative to the wall supports surrounding the slab to thereby cause defects in the structure. When this occurs there are only two basic methods of correcting the problem. The first require the slab to be removed. This means the slab must be broken up and removed in manageable pieces. Thereafter, additional fill is supplied to raise the supporting surface of the slab to its required condition and a new slab run in place. If the defective slab is within the interior confines of a building these procedures are very expensive and disruptive to the total building structure.

The other commonly used method of correcting for slabs which have settled beyond their original position is by injecting, under hydraulic pressure, a liquid grout, such as a concrete slurry, under the slab. The hydraulic force of the injected slurry causes the slab to be upwardly displaced. When the required slurry has been injected to raise the slab to its desired position the injection is terminated. When the slurry solidifies the slab is restored to its proper position and supported by the solidified slurry. This method has proven much more acceptable than the first mentioned method in most instances, however, it has significant disadvantages. One of the problems is that a relatively high hydraulic pressure is required to supply the lifting force necessary to raise the slab to its required elevational position. This hydraulic force tends to cause the grout slurry to migrate into adjacent portions of the building. The problem is particularly serious if duct work such as used for heating and air conditioning extends underneath the slab. The hydraulic force necessary to lift the slab in many instances is sufficient to cause the duct work to collapse or, if the duct work does not collapse, leakage of the grout into the duct work can cause serious problems.

The present invention is directed towards an alternate means of positioning a slab and supporting it in the desired elevational position. In practicing the method of this invention an opening is formed in the slab such as approximated two to four inches in diameter. The opening will typically be positioned adjacent the center of gravity of the slab. If the slab is relatively large, more than one opening may be provided at spaced intervals. The invention will be described, for purposes of simplicity, wherein the slab is of typical dimensions such as that of an average room in a residence in which case only a single opening is necessary in the center of the slab to practice the invention.

After the opening is formed a plate is placed on the top surface of the slab surrounding the opening, the the plate having a large opening conforming to that in the slab. In addition, the plate has a plurality of small diameter openings spaced away from the large opening. Through these smaller diameter openings bolt receiving holes are drilled in the concrete slab. Thereafter, bolts are extended through the small diameter openings in the plate to secure it to the top surface of the slab. Lead or plastic anchors will normally be employed in the openings after they are drilled to receive the bolts.

The plate has means to removeably receive a jack. While the jack may take a variety of forms a preferred arrangement employs the use of a hydraulic jack having a cylinder, with a piston reciprocally extending from the cylinder. The cylinder includes a frame which downwardly extends from it, the lower end of the frame being removeably attached to the floor plate. The piston is thus reciprocally supported in axial alignment with the openings in the plate and in the slab.

A series of tubular shaft members are forced downwardly through the plate and the slab by means of the jack. The shaft members may typically be tubular metal members of length such as from one and one half to three feet and are arranged so that the ends can interlock with each other. This is accomplished by providing telescopically extending portions on the lower ends of each of the tubular shafts to extend a short distance into the upper end of the next lower adjacent tubular shaft. In this manner a series of shafts may be forced downwardly through the slab to engage the earth beneath the slab. When the shafts have been forced downwardly a sufficient distance adequate upward force is applied on the slab to lift it to the desired elevational position.

When the slab is in the desire elevational position it is then necessary to support it in some way. This can be accomplished by inserting beneath the slab support material which may be sand or other granular material which can be injected by air pressure. However, a preferred means is to inject a liquid grout, such a cement slurry. This can be easily accomplished by the principles of this invention in which a length of tubular shaft has openings in the sidewalls. When the shaft has been raised to its desired position the last length of tubular shaft is of the type having sidewall openings is employed. A clamp may then be attached to the last required length of tubular shaft to support the plate to the shaft permitting the removal of the jack. Thereafter, a flexible conduit may be attached to the upper opened end of the tubular shaft and a cement slurry injected through it, the slurry passing downwardly through the tubular shaft to emerge through the openings in the sidewall. The slurry will disperse beneath the slab to form a bridge between the earths surface and the lower surface of the slab. When sufficient cement slurry or other liquid grout is thus placed in position it is allowed to solidify, thus supporting the slab in its upward position. The injection need not be at high pressure since it is not required to utilize the hydraulic force of the injected slurry to lift the slab, the slab already having been lifted to its desired position. Thus the supporting grout or slurry may be injected at relatively low pressure so that the likelihood of damage to other building components, such as duct work, is substantially reduced.

After the slurry is solidified sufficiently to retain the slab in its raised position the floor plate and the uppermost length of tubular shaft are removed. Thereafter the opening in the slab may be filled with a grout which, upon solidification, closes the opening formed in the slab. In like manner the small diameter bolt receiving openings may be filled with grout.

Since it is not necessary to extend any implements underneath the slab to engage the lower slab surface all of the activities are carried out on the upper surface of the slab and can be accomplished expeditiously. Since only small hydraulic forces are required to move the liquid grout, large equipment is not employed. Thus the project of lifting and stabilizing a slab can be accomplished with minimal damage to or disruption to other portions of the building structure.

DESCRIPTION OF THE DRAWINGS

FIG. 1 shows in cross-section a plate member as employed in the invention attached to the upper surface of the slab in alignment with an opening which has been formed in the slab.

DETAILED DESCRIPTION OF THE PREFERRED EMBODIMENT

Figure 1:
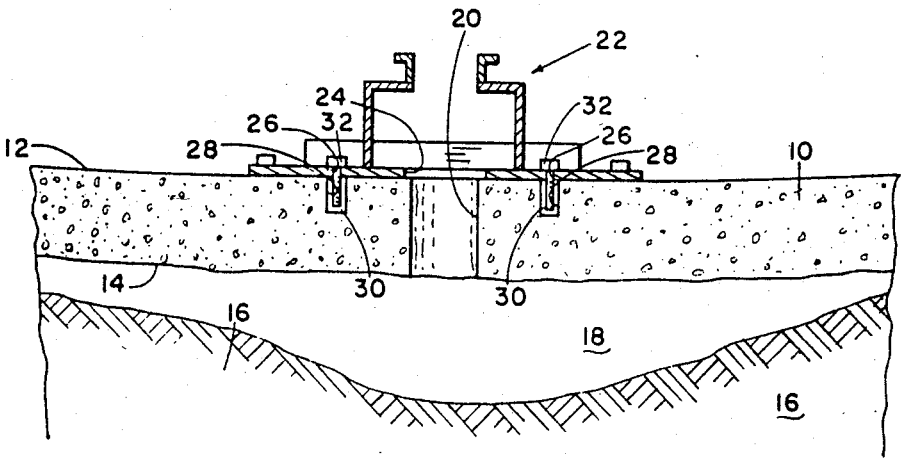
FIG. 1 is a cross-sectional elevational view of a portion of a slab showing the condition in which the earths surface beneath the slab has settled so that the slab lacks adequate support.
Figure 9:
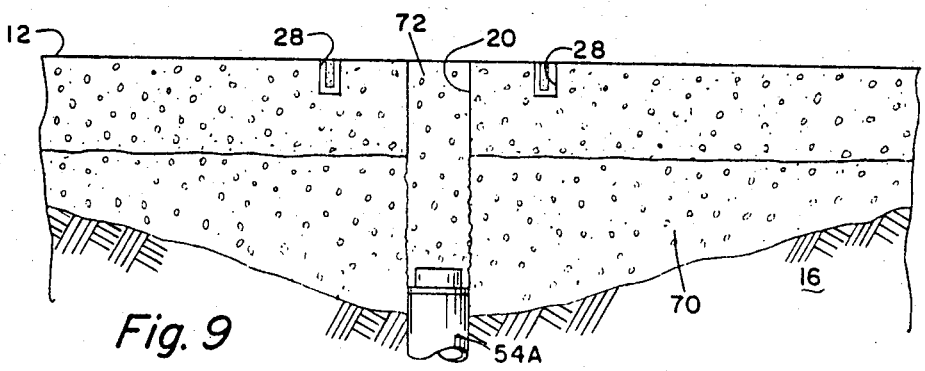
FIG. 9 is a view of the slab after the plate, jack and shafts have been removed and the openings in the slab filled to complete the job of raising and stabilizing the slab.

FIG. 1 shows a concrete slab 10 which typically is a floor of a residential or commercial building. The slab 10 has an upper surface 12 which functions as the floor surface and a lower surface 14. The upper surface 12 is usually smooth, flat and level when the slab is installed. The lower surface 14 conforms to the surface of the earth when the slab 10 was poured during the construction of the building. In building construction wherein an earth slab is utilized for the floor the slab is poured directly on the earth or on fill material positioned on the earth to form the desired level of the bottom of the slab. The earth 16, whether actual earths surface or fill, then supports the bottom of the slab 14 and as long as sufficient support is provided slab 10 will remain stabilized in position and serve as an excellent floor material. However, if for any reason the support deteriorates, either by settling, being dissolved or washed away by flowing water, or whatever, and a void 18 occurs beneath the slab lower surface 14, the slab will tend to settle. This can result in substantial impairment of the quality and usefulness of the building structure. The purpose of this invention is to provide a means of raising and stabilizing slab 10 to a desired position.

For this purpose, the first step is to form an opening 20 in the slab which may be of approximately two to four inches in diameter and which may be drilled in the slab by means of a concrete cutting drill. After opening 20 is formed a plate member, generally indicated by the numeral 22, is positioned on the upper surface 12. The plate has an opening 24 therein which is positioned to conform with opening 20 in the slab. In addition, the plate has smaller diameter openings 26. The position of these openings 26 are marked. Subsequently the plate may be temporarily set aside and small openings 28 formed in the slab 10. Expandable anchors 30 such as made of lead, plastic or the like, are positioned in the openings 28. The plate is repositioned onto the slab and bolts 32 installed. The plate 22 is thus securely attached to the slab upper surface.

Figure 4:
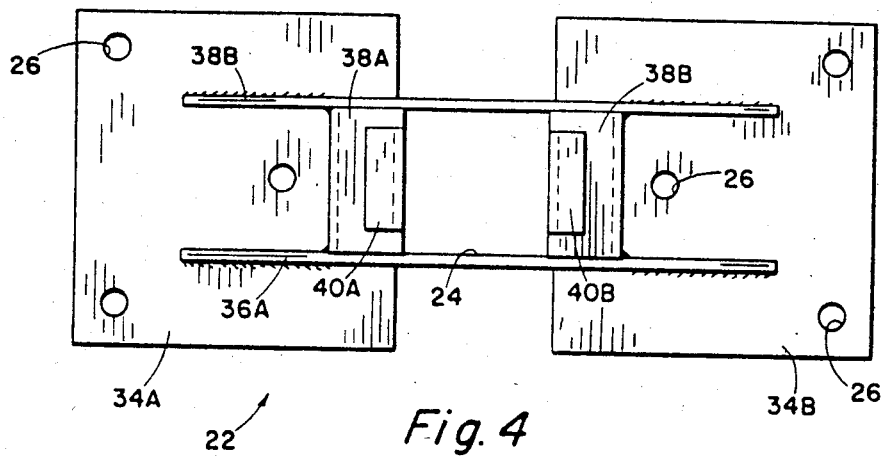
FIG. 4 is a top plan view of the plate member.
Figure 2:
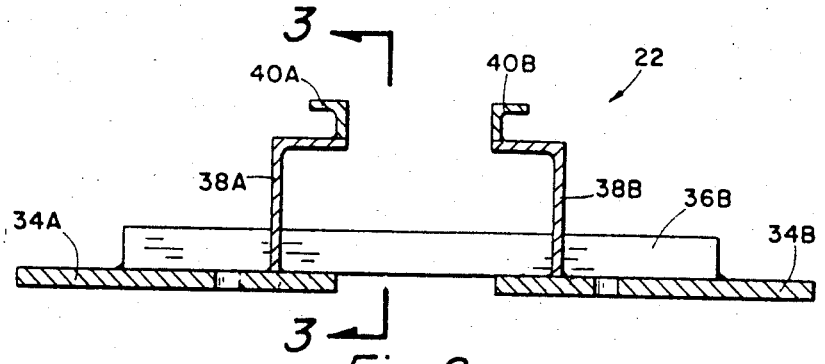
FIG. 2 is an enlarged cross-sectional view of a preferred embodiment of the plate member as employed in the invention.
Figure 3:
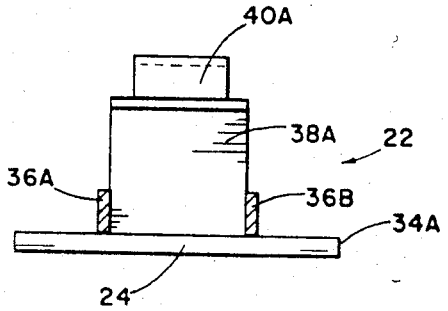
FIG. 3 is a cross-sectional view of the plate member as taken along the line 3—3 of FIG. 2.

By referring to FIGS. 2, 3 and 4 more details of the plate 22 will be seen. These views show merely one example of the way the plate can be constructed. It is understood that the plate may have a variety of other configurations which have physical appearances completely dissimilar to that illustrated here but which function for the same purpose. In this illustrated arrangement of plate 22 there are two flat horizontal portions 34A and 34B which have the small openings 26 therein. Vertical elongated cross members 36A and 36B are welded to the upper surface of plates 34A and 34B. Positioned between the cross members are members 38A and 38B which are of an inverted L-shaped configuration and each has welded to the upper outer end of the leg portion a reinforcing member 40A and 40B respectively. Thus the plate 22 can be formed inexpensively of readily available structural components without requiring machining or casting of any component. The opening 24 formed in the plate 22 is defined by the adjacent edges of plates 34A and 34B and by the cross members 36A and 36B.

Removeably positioned on the plate 22 is a jack, generally indicated by the numeral 42. The jack may take many forms and may be pneumatically, hydraulically or mechanically actuated. It may include a mechanical type operation such as any typical automotive type jack. In the illustrated arrangement it is in the form of a hydraulic cylinder 44 having a downwardly extending reciprocal piston 46. By means of hydraulic force applied by hoses 48A and 48B piston rod 46 may be extended or withdrawn.

Figure 5:
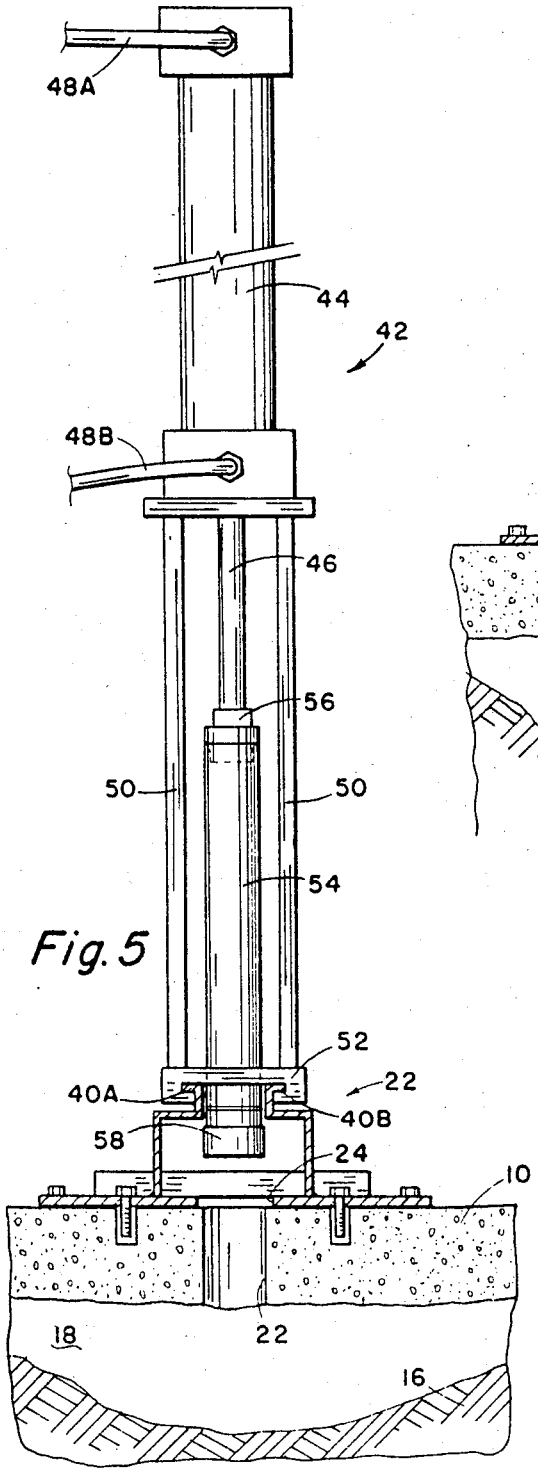
FIG. 5 is an elevational view of a jack supported to the plate and showing the steps employed in practicing the invention.
Figure 6:
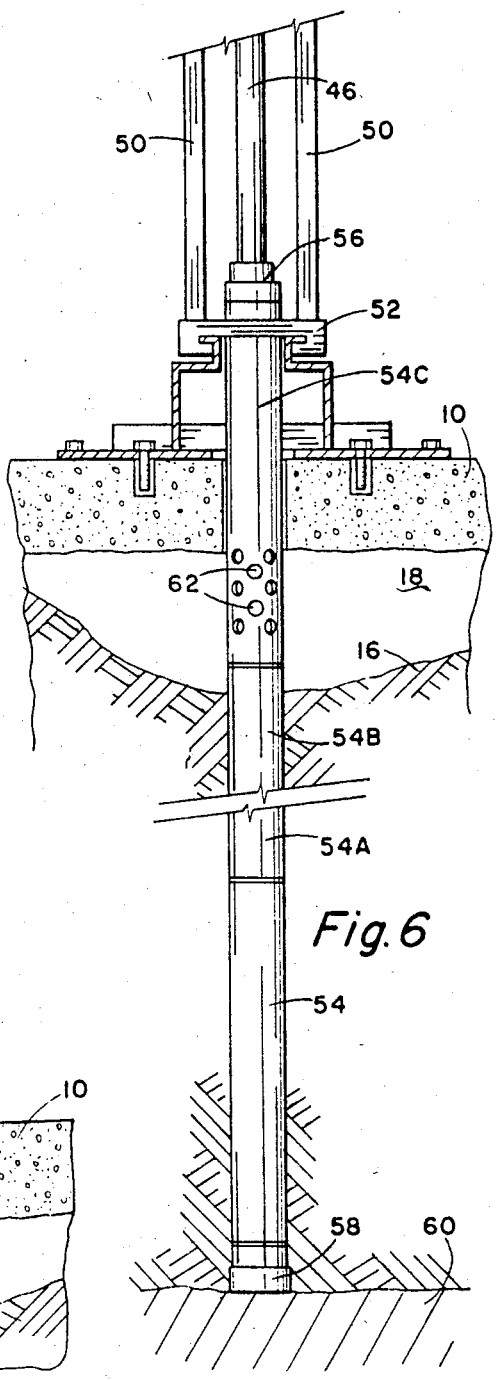
FIG. 6 is an elevational view as in FIG. 5, showing only the lower portion of the jack apparatus, and showing the shaft portion of the apparatus used having been forced downwardly to a stabilized condition and which lifting force is applied to the slab to lift it to its desired position.

Hydraulic cylinder 46 is supported on an elongated upright base 50 having a lower end 52 which, in cross-section, is C-shaped and is adapted to slideably receive the plate reinforcing member 40A and 40B. As seen in FIG. 5 the jack 42 is supported uprightly over the openings 22 and 24 formed in the slab and plate respectively.

In order to apply lifting force on the slab at least one shaft member 54 is employed. The shaft member 54 may be of any type structural material such as formed concrete post, sturdy wood post or metal posts of various configurations; however, the preferred arrangement is that the shaft member 54 be of a tubular metal and of diameter to be slideably received through openings 22 and 24. An adapter 56 is affixed to the lower end of piston 46 to engage the upper end of the shaft member 54.

While the shaft member may be on a single element in the preferred embodiment a series of shaft members 54 are employed of relatively short length. The shaft members may be of approximately two to four inches in diameter, or although they may be larger or smaller depending upon the size and thickness of the slab 10. Since the slab 10 will normally be within the interior of a building the height limitations imposed on the jack 42 requires that the maximum length of the shafts 54 be approximately one and one half to three feet. In this way a sequence of shafts may be employed to be driven downwardly through opening 22 in the slab to a depth necessary to supply a base against which upward lifting force is employed to lift the slab 10. The first shaft 54 may be equipped with a slightly enlarged base 58, the base being nevertheless of a diameter so that it will extend through the openings 22 and 24.

With the jack 42 and shaft 54 installed as in FIG. 5 hydraulic force may be delivered to the cylinder 44 to drive piston 46 downwardly. After it has been driven downwardly to a sufficient length the piston 46 may be withdrawn and a subsequent tubular shaft 54A be installed. This sequence may be repeated until the base 58 of the first shaft reaches a secure footing, such as when the base engages a solid earth sub-structures 60.

When sufficient lengths of shaft members 54 have been added so that the base 58 engages stable earth sub-structure further downward force by piston 46 will lift slab 10. This force may be accurately controlled until the slab is lifted to its desired elevational position.

Figure 10:
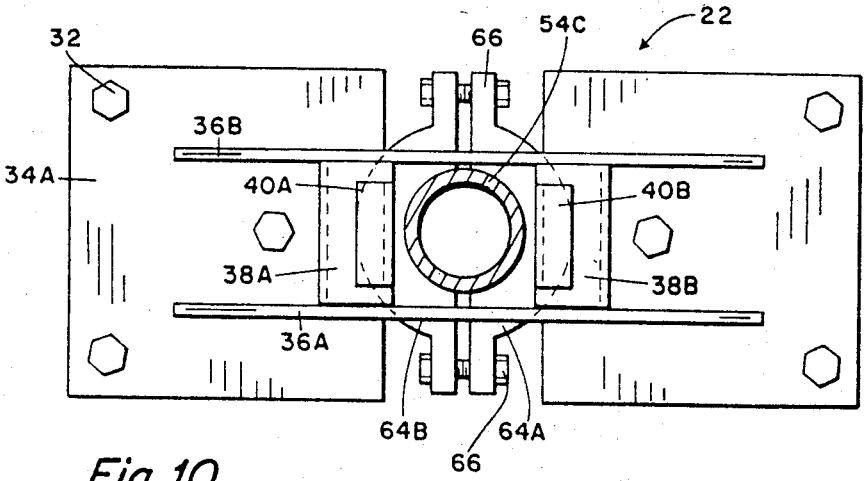
FIG. 10 is a cross-sectional view taken along the line 10—10 of FIG. 7 showing the top of the plate member and with the support clamp in position as the apparatus is in condition for the deposit fill material beneath the slab.
Figure 7:
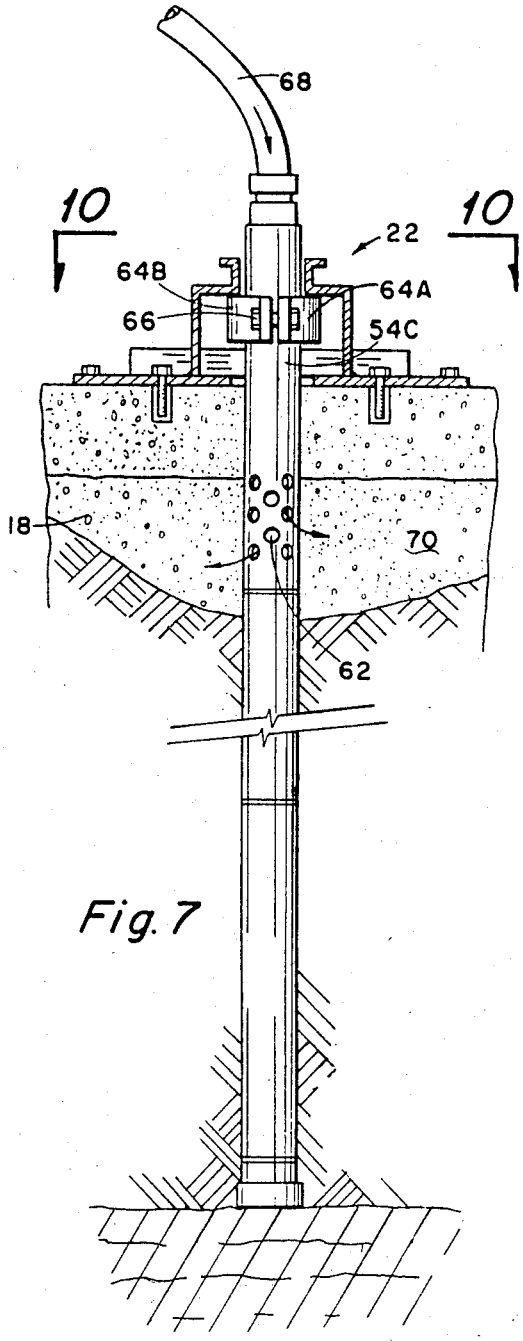
FIG. 7 is an elevational view as in FIGS. 5 and 6 showing the step of injecting a liquid grout, such as a cement slurry, into the area beneath the slab to provide support.

When the slab is in its desired elevational position the next step in the method is to stabilize the slab in such position. This is best accomplished by inserting into the void 18 below the slab a stabilizing material. This can be in the form of sand or other granular material or it may be in the form of a liquid grout which solidifies after time, such as a cement slurry. This slurry could be injected into void 18 by drilling a second opening (not shown) in the slab. However, a preferred means according to this invention employs a special shaft member 54C which has openings 62 in the sidewall thereof. When the slab 10 has been lifted to its desired position with the last used shaft being of the type having opening 62 therein, the elevational position of the slab may be held in place by utilizing a clump or collar 64 as shown in FIG. 7. The collar is positioned around the shaft 54C and tightened. In the illustrated arrangement the collar is formed of two halves 64A and 64B which are held together by bolts 66, only one of which is seen in FIG. 7, both are seen in FIG. 10. After collar 64 is securely positioned about the shaft member 54C the jack 42 may be removed. This is accomplished by upwardly withdrawing piston 62 and sliding the jack lower end 52 out of engagement with the plate reinforcing members. After the jack has been removed a flexible conduit 68 may be attached to the upper end of shaft 54C. A supporting material may then be injected, such as sand moved by air which passes down into the void 18 through the openings 62 in shaft 54C or, more preferably, may be in the form of a liquid grout such as a cement slurry. The slurry fills the void 18 beneath the slab 10. Since the slab is already lifted to the desired position it is not necessary that the slurry 70 be introduced under sufficient pressure to apply hydraulic lifting force on the slab. The only requirement is that the slurry 70 be injected so as to fill or substantially fill the void 18 as necessary to provide stabilizing force on the slab. Since the slurry can be deposited only under minimal pressures the possibility of damage to other equipment in the building, such as heating and air conditioning ducts, water pipes, electrical conduits, and so forth is greatly reduced.

Figure 8:
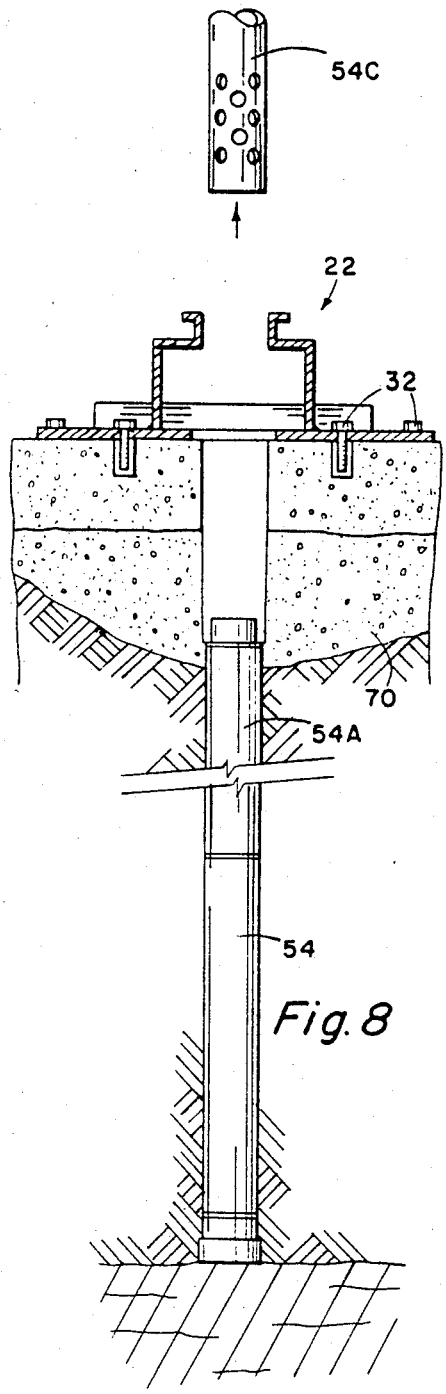
FIG. 8 is an elevational view as in FIG. 7 showing the upper tubular shaft member having been removed from the plate after the liquid grout has partially solidified.

After the slurry 70 has been injected and after it has partially solidified the clamp and the uppermost shaft 54C may be removed as shown in FIG. 8.

To complete the job of raising and stabilizing the slab, plate 22 is removed by removing bolts 32. Thereafter the hole 22 in the slab and the opening in grout 70 remaining when the upper shaft 54C is removed is filled by grout 72. The small amount of grout 72 may be deposited manually and the closed opening finished to retain the smooth upper surface 12 of the slab. Small holes 28 may also be filled so that the entire upper surface of the slab is completely restored. The shafts 54 and 54A remain in position to provide substantial stabilizing force on the slab 10 so that even if small amounts of settling of the earth 16 occurs after the slab has been elevated and stabilized, the shafts will serve to retain the slab in position.

All of the activities to raise and stabilize the slab are conducted on the slab upper surface 12. These required steps can be done expeditiously and with a minimum of interruption to other areas of the building. Since only low pressure delivery of the stabilizing grout is required heavy machinery is not utilized. The hydraulic force necessary to drive the shafts 54, 54A, 54C, etc. can be accomplished with a relatively small hydraulic pump or can even be supplied by a hand operated pump.

As previously indicated the shafts 54 indicated by 54, 54A, 54B, and 54C are designed so that their adjacent ends are held axially in position. This can be accomplished by small diameter tubular portions formed in one end of each shaft length or the shafts may be threadably engaged with each other.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of restoring and stabilizing a sunken concrete slab to its desired position on the earth's surface comprising the steps of:

boring a vertical opening through the slab;

attaching a plate structure to the slab upper surface, the plate structure having an opening therethrough in alignment with the opening in the slab;

driving a vertical support column vertically through said openings in the plate structure and the slab and into supporting engagement with the earth;

applying lifting force between the driven support column and the plate structure to lift the slab to its desired position; and inserting fill material between the lifted slab and the earth's surface to stabilize the slab in its lifted position.

2. A method of positioning said stabilizing a concrete slab according to claim 1 including:

detaching the plate structure from the slab after the slab has been stabilized; and patching said opening formed in said slab.

3. The method of claim 1 wherein the step of driving a vertical support column and applying lifting force is accomplished employing hydraulically actuated forces.

4. The method of claim 1 wherein the step of inserting stabilizing material under the lifted step includes injecting a fluid grouting material under the lifted slab.

5. The method of claim 4 including the step of injecting fluid grouting material includes the step of injecting a cement slurry under the lifted slab.

6. The method of claim 5 wherein the fluid grouting material is injected through the opening receiving the vertical support column.

7. The method of claim 6 wherein the fluid grouting material is injected through the vertical support column.

* * * * *